United States Patent [19]

Pohorski

[11] Patent Number: 4,495,974

[45] Date of Patent: Jan. 29, 1985

[54] HOT AIR ASEPTIC PACKAGING SYSTEM AND METHOD

[75] Inventor: Daniel W. Pohorski, San Jose, Calif.

[73] Assignee: James Dole Corporation, Redwood City, Calif.

[21] Appl. No.: 494,276

[22] Filed: May 13, 1983

Related U.S. Application Data

[62] Division of Ser. No. 236,766, Feb. 23, 1981, abandoned.

[51] Int. Cl.[3] ..... B65B 43/42

[52] U.S. Cl. ..... 141/132; 141/163; 141/85

[58] Field of Search ..... 141/11, 82, 84, 85, 141/129, 132, 163, 177, 133, 134, 387; 222/566

[56] References Cited

U.S. PATENT DOCUMENTS

| | | | |
|---|---|---|---|
| 2,185,191 | 1/1940 | Gray et al. | 141/11 X |
| 2,498,401 | 2/1950 | Duncan | 141/82 X |
| 2,631,768 | 3/1953 | Martin et al. | 141/134 |
| 2,827,928 | 3/1958 | Guckel | 141/134 |
| 3,138,178 | 6/1964 | Martin | 141/82 |
| 3,828,833 | 8/1974 | Smith et al. | 141/85 |
| 4,182,387 | 1/1980 | Buckley et al. | 141/129 |

FOREIGN PATENT DOCUMENTS

| | | | |
|---|---|---|---|
| 1292740 | 3/1962 | France | 141/129 |

*Primary Examiner*—Stephen Marcus

*Assistant Examiner*—Ernest G. Cusick

*Attorney, Agent, or Firm*—Julian Caplan

[57] ABSTRACT

Containers (such as metal, glass, plastic, fiber, but not limited thereto) are sterilized in a section of the apparatus having a helical or spiral belt conveyor within an insulated casing through which air above atmospheric pressure at up to about 500° F. is circulated by means of a heater and blower, in a recirculation path. The containers then travel along a straightline encased conveyor where sterile air above atmospheric pressure prevents ingress of non-sterile ambient air. During part of the path through the straight-line conveyor, the containers are driven by a helical screw which forces the containers into close proximity (in fact the out-turned flanges of the containers preferably overlap). Pre-sterilized, preferably cooled, product is delivered into the containers preferably through a curtain, slit-type filler. Other fillers, such as rotary fillers, may be used. The speed of the containers is timed to deliver the desired product volume into the containers. Thereafter, filled containers are accepted by a container closing machine. Container lids or covers (herein "lids") are sterilized in a section of the apparatus where lids are moved along a conveyor and sterile air which has been heated is forced by a blower into the lid sterilizer section. The lids then travel up a tunnel at greater than atmospheric pressure, where they are cooled and delivered to the closing machine. The closing machine applies the sterile lids to the containers at greater than atmospheric pressure.

8 Claims, 19 Drawing Figures

HOT AIR ASEPTIC PACKAGING SYSTEM AND METHOD

This is a division of application Ser. No. 236,766, filed Feb. 23, 1981, abandoned.

This invention relates to a packaging system and method of packaging. Steam aseptic packaging systems and methods have been used commercially for many years. The substitution of other heated gases (including air) for steam is noted in literature (e.g. Martin Patents No. 2,549,216 and No. 2,631,768). The use of hot air as contrasted with steam offers a number of important advantages.

One of the most important advantages is the saving in energy required to vaporize water to create steam, with a consequent saving in fuel expenses. It has been found that at somewhat increased volumes the lethality of hot air is comparable to that of superheated steam. Within the sterilizing sections of the system, the heated air is recirculated providing for increased energy conservation and savings.

A second important advantage of the use of hot air is a lessening of deterioration of parts which have heretofore been attacked by the steam and also a lessening of the saturation of the insulation of the casings occasioned by condensation of water in such insulation, lessening its thermal efficiency.

Still another advantage of the present invention is the fact that when steam is used in the headspace of a container, because of condensation, there is a tendency to collapse the walls of the container. Using hot air eliminates this tendency and therefore permits the use of thinner walls of metal and glass containers and also makes the use of fiber and plastic containers practical, along with other containers constructed with less rigid material.

A further feature of the present invention is the reduction in the required floor space of the packaging facility.

A still further feature of the invention is an additional reduction in energy requirements by recirculation of air in the container and lid sterilizing and other portions of the system.

Another feature of the invention is the cooling of the containers to about 75°–90° F. prior to being filled and their being filled with a pe-sterilized product which has been cooled. By sterilizing and then cooling containers and by sterilizing and then cooling the air which exist at greater than atmospheric pressure in the filler area, pre-sterilized and cooled product may be filled into the containers at a much lower temperature is possible than where steam is employed, thereby avoiding the deterioration at elevated temperatures which otherwise occurs. Furthermore, containers made of products such as fiber are less likely to be damaged under the conditions heretofore set forth. This reduces degradation of the product.

An improved filler is hereinafter described in detail, this filler being a modification of one commercially used. Among the features of the filler are the fact that the slit through which product is discharged is interchangeable, the width of the slit determining the volume of product dispensed. Merely by substituting parts having slits of different widths, this adaptability of a standard filler to different rates of product flow is achieved.

Another feature of the filler hereinafter described is its adjustability for different heights and widths of containers. The filler tube in which the slit heretofore mentioned is installed is supported in the filler chamber in such manner that it may readily be raised and lowered to accommodate different container heights. Additionally, the guides which maintain straight line travel of the containers may be moved apart or together to accommodate different container widths.

Another feature of the filler is the fact that, if desired, cooling water may be sprayed on the sides of the containers prior to filling to reduce the temperature of same. At least one of the guides heretofore mentioned may consist of a tube having spray holes through which sterile, cooled water may be sprayed on the containers as they pass therealong.

Still another feature of the invention is the use of a valve installed between the pump or gravity feed of the product and the filler to prevent overflow of product, which might otherwise clog the filler and require the line to be shut down until the overflow is cleaned and also to maintain the product being forced into the filler at a uniform pressure.

Another feature of the invention is the use of pressurized air to prevent introduction of non-sterile air from the atmosphere into the system after the container and lids have been sterilized.

An additional advantage of the invention is that many of the components of the system comprise adaptions of standard pieces of equipment, thereby making unnecessary large scale redesign of these components and large inventories of spare parts.

Still another feature of the invention is the provision of continuous visual inspection of the product, containers and lids through windows provided in the various components.

Other objects of the present invention will become apparent upon reading the following specification and referring to the accompanying drawings in which similar characters of reference represent corresponding parts in each of the several views.

Figure 1:
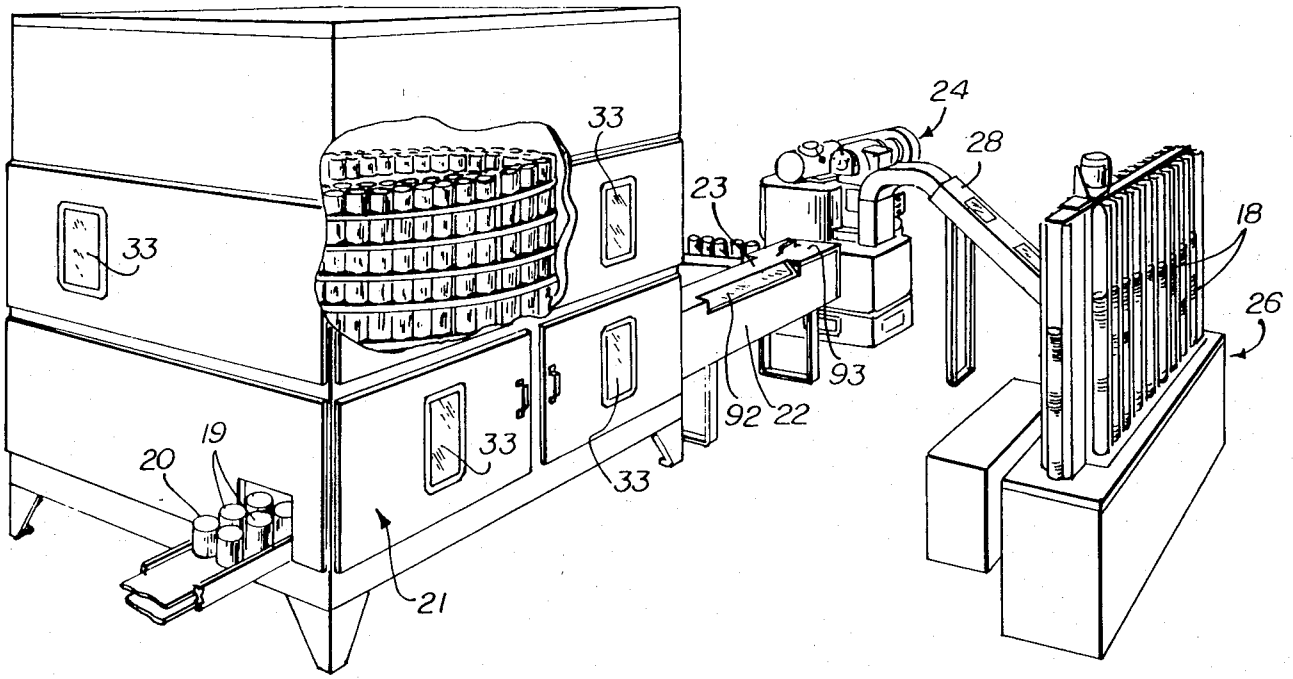
FIG. 1 is a schematic perspective view of the system in accordance with the present invention.

Directing attention to FIG. 1, the essential components of the system are set forth. Containers 19 having top flanges 20 and which may be metal, fiber, glass, plastic or other material are fed into a container sterilizer 21 where they are heated to a temperature of up to approximately 500° F. by hot air. The containers then pass through a straightline conveyor 22 which includes a filler section 23 where a pre-sterilized, cooled liquid or semi-liquid product is filled into the containers. From the conveyor 22 the containers pass into a closing machine 24 which is a modified, enclosed adaptation of a well-known commercially available machine. Meanwhile the lids 18 for the containers, deposited in a lid storage magazine 26 pass through a lid sterilizer 27 and thence up an inclined lid conveyor 28 to the closer 24. In the closer 24 the lids are attached to the container. The components of the system will be described in detail.

CONTAINER STERILIZER

Figure 2:
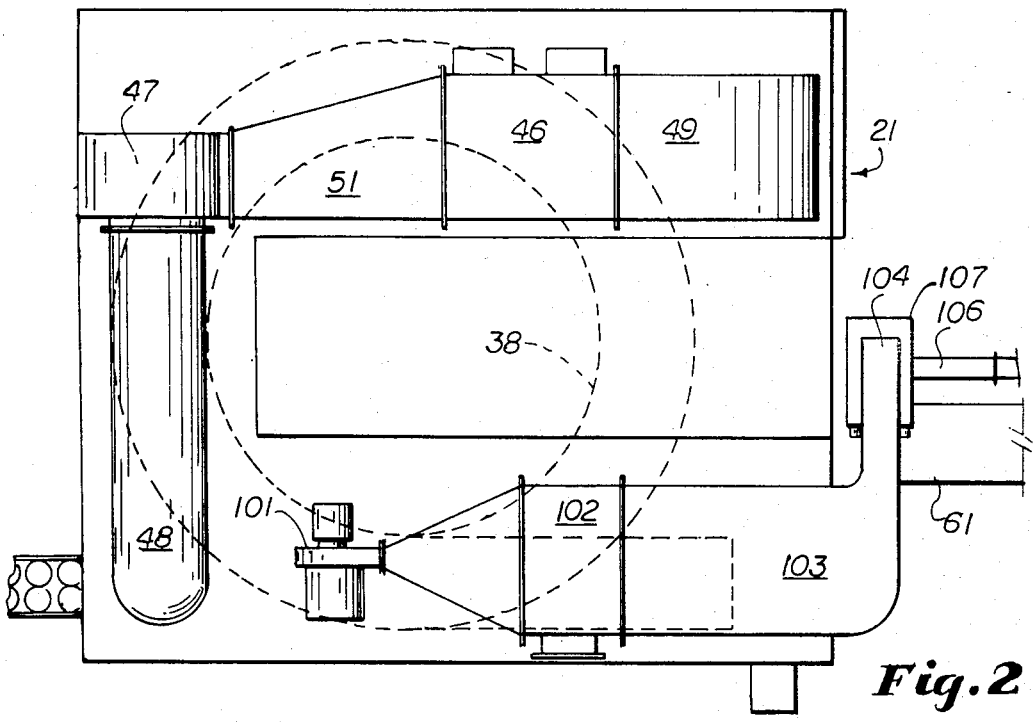
FIG. 2 is a top plan view of the container sterilizer portion of the invention.
Figure 3:
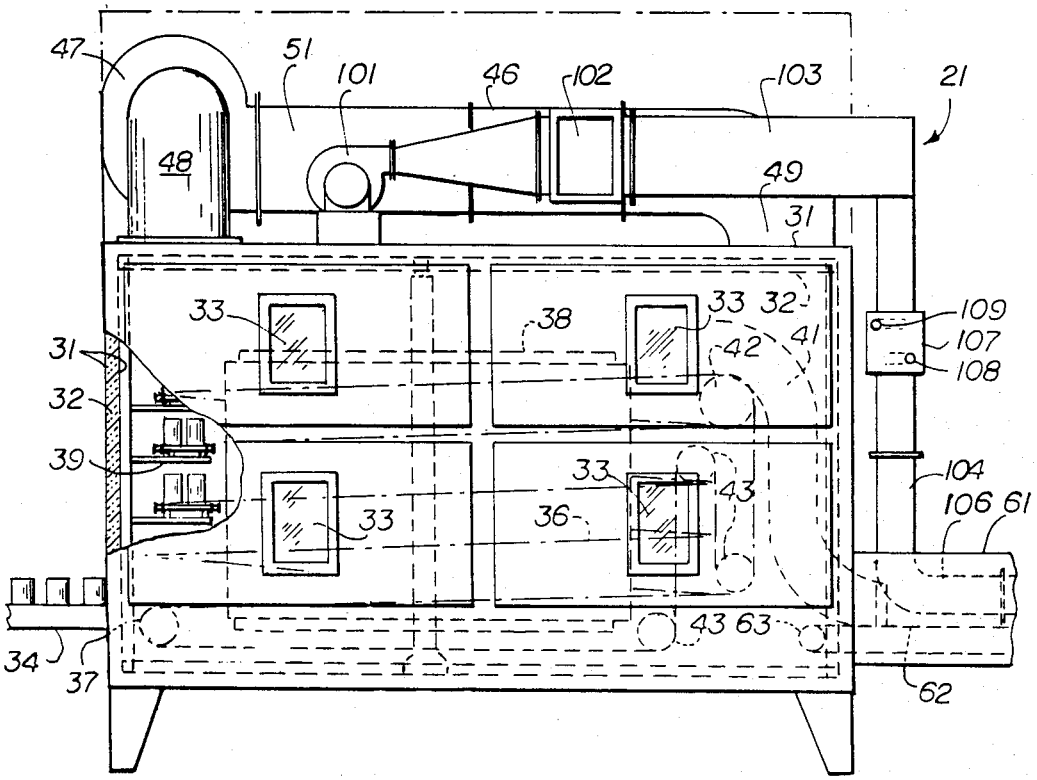
FIG. 3 is a side elevational view of the structure of FIG. 2 partly broken away in section to reveal internal construction.
Figure 4A:
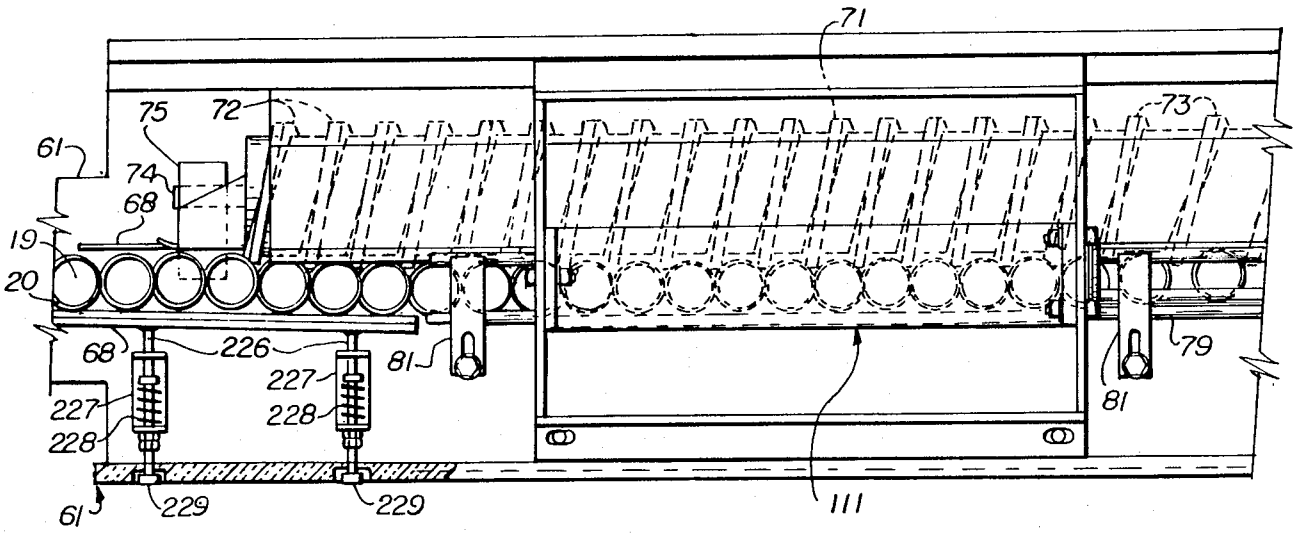
FIGS. 4A and 4B are a composite top plan view of the container tunnel and filler portion of the apparatus.
Figure 4B:
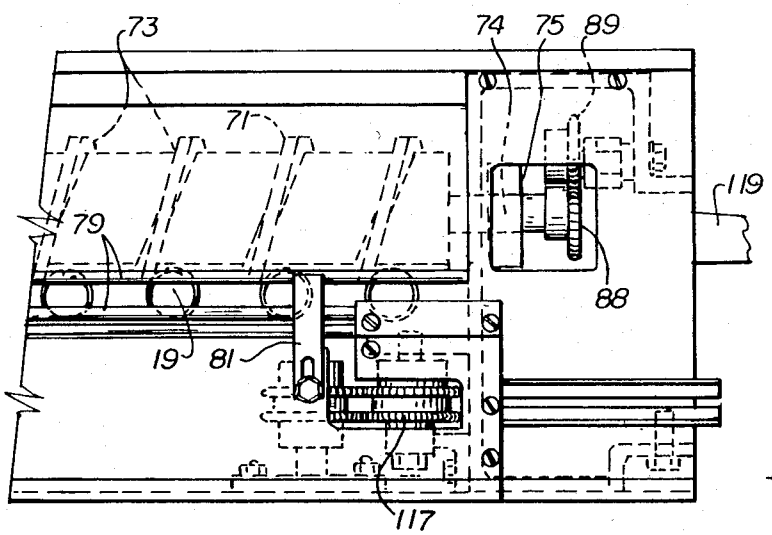
Figure 5A:
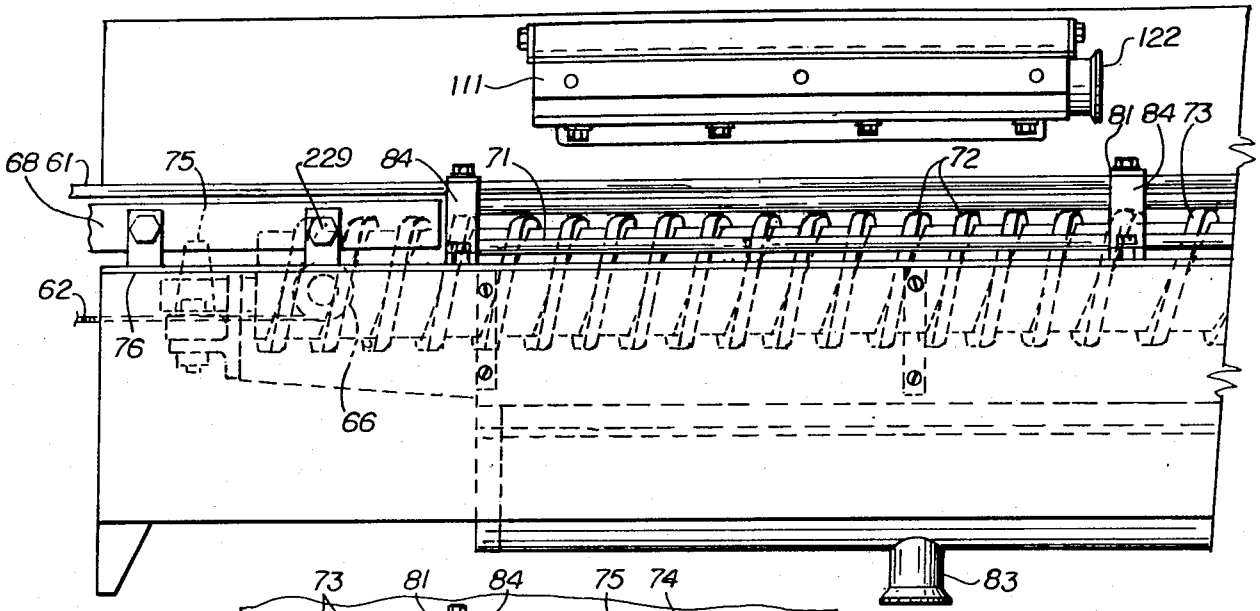
FIGS. 5A and 5B are a composite side elevational view of the structure of FIGS. 4A, 4B.
Figure 5B:
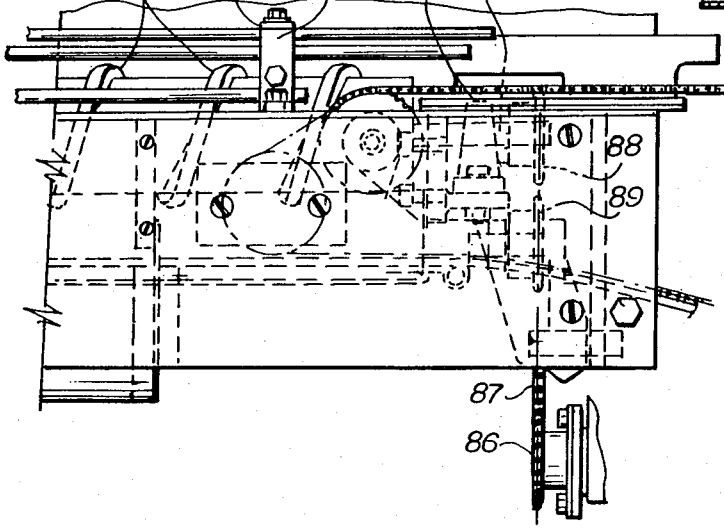
Figure 7:
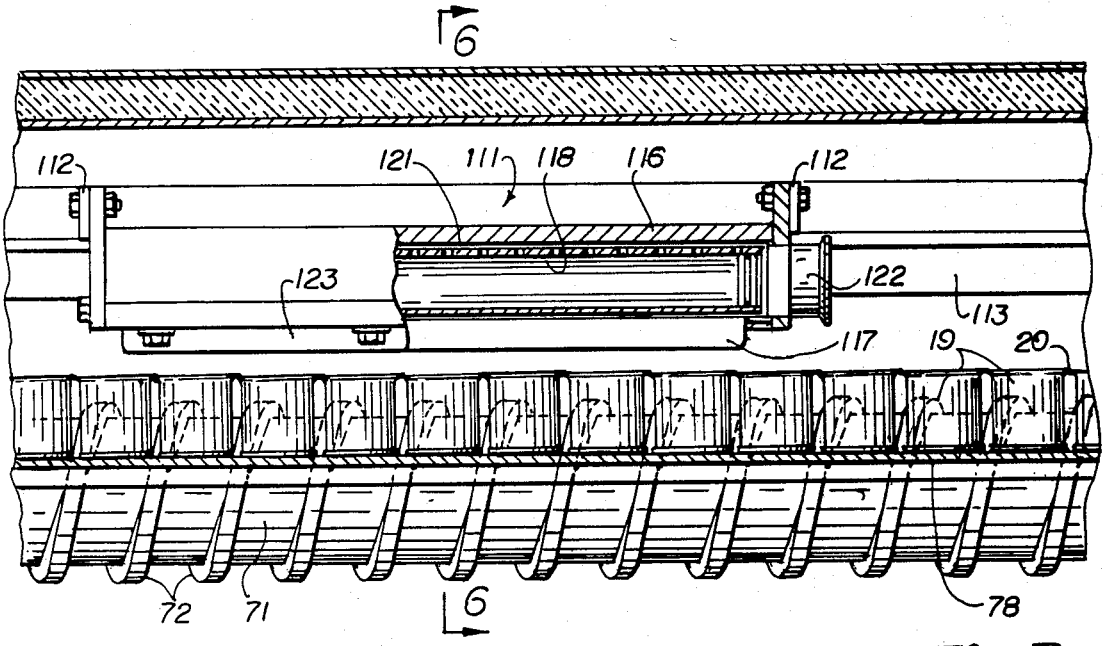
FIG. 7 is a fragmentary sectional view taken substantially along the line 7—7 of FIG. 6.

The container sterilizer 21 shown in some detail in FIGS. 2 and 3 has a double walled casing 31 filled with a heat insulation material 32. In the walls of the casing 31 at convenient intervals are observation windows 33. The containers 19 are fed into sterilizer 21 through the container inlet 34 preferably in double file. From the bottom of the inlet 34 the containers, still in double file, pass onto a conveyor belt 36 which passes around and over the power driven intake pulley 37. The conveyor belt 36 passes in a helical upward path around a central primary drum 38. A helical trackway 39 supports the belt 36 in its path. The containers pass down through a discharge chute 41 and out of the casing 31. The belt 36 is directed by end pulley 42 and addtional pulleys 43 back to the intake pulley 37. The structure herein illustrated is a modification of a commercially available conveying system such as that shown in U.S. Pat. No. 3,348,659.

Mounted at a convenient location such as the top of the sterilizer 21 is a heater 46 which may be electric, gas or oil fired. In a preferred device a resistance electric heater is used. A blower 47 forces controlled air up from the air return duct 48 through duct 51 which contains the heater 46 and then down through inlet duct 49 which leads into the casing 31. The air is preferably at a suitable temperature such as 300° for fiber containers which is sufficient to sterilize containers when they are subjected to such a temperature for a period of about 60 to 240 seconds, normal time for containers 19 to pass through the sterilizer 21. For metal and glass containers 450° F. is suitable. The resident time in the container sterilizer may be varied by increasing or decreasing the speed of the conveying system.

CONTAINER TUNNEL AND FILLER

Communicating with the lower end of the discharge cute 41 is a horizontally disposed tunnel 61. Continuously moving within the tunnel 61 is a conveyor chain 62 and onto the horizontal top stretch of the chain 62 the containers pass in single file. Pulley 63 designates the driver pulley at the proximal end of the tunnel 61.

About midway of the tunnel 61 is an idler pulley 66 around which the chain 62 passes and returns to pulley 63.

Containers 19 are restrained as they are discharged from chain 62 and received in helix 71 by guide 68. Guide 68 carries horizontal rods 226 which slide in holes in U-shaped brackets 227 and are biased inwardly by springs 228. Brackets 227 are adjustably held by bolts 229 threaded into the wall of tunnel 61. The heads of bolts 229 are externally accessible for adjustment.

Figure 6:
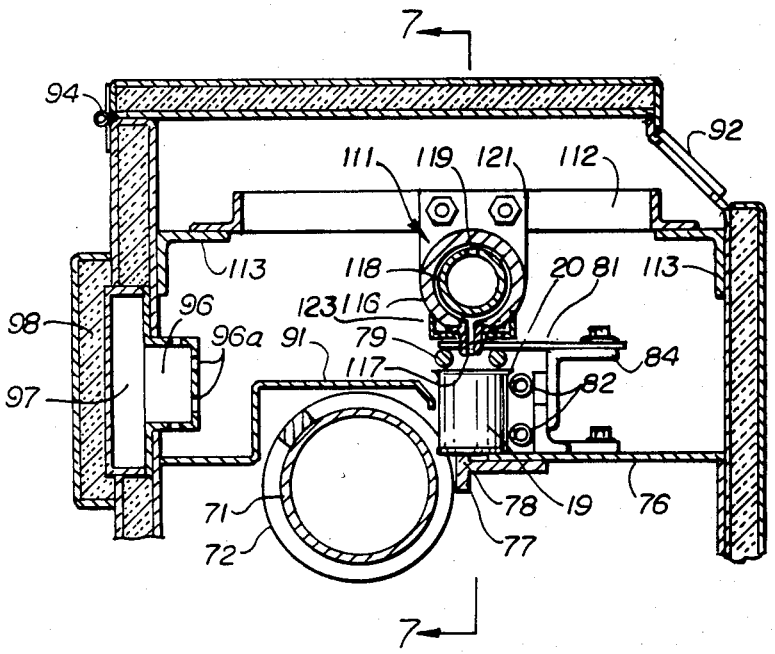
FIG. 6 is a transverse sectional view taken substantially along the line 6—6 of FIG. 4A.
Figure 8:
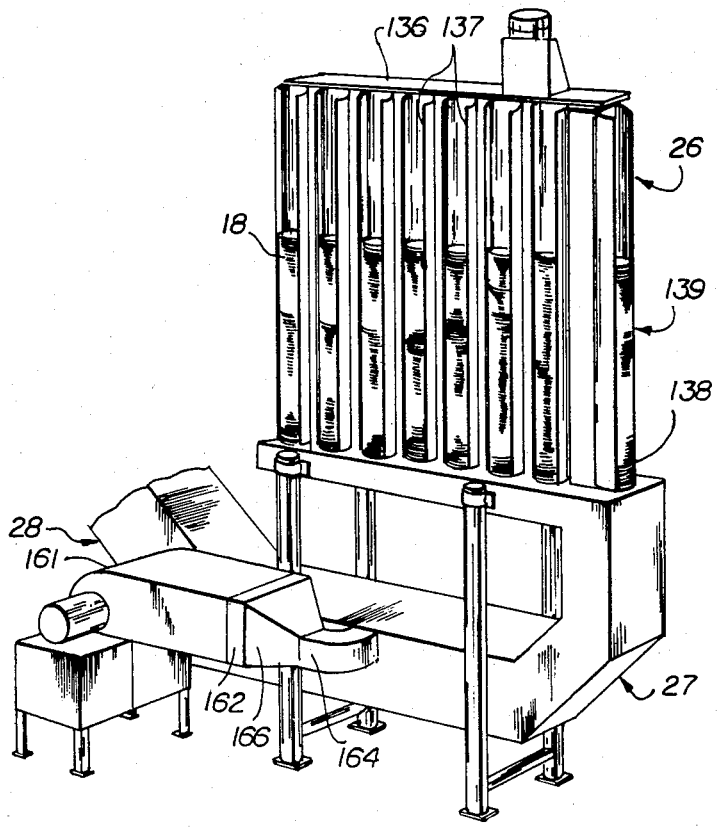
FIG. 8 is a perspective view of the container lid feed and sterilizer.
Figure 9:
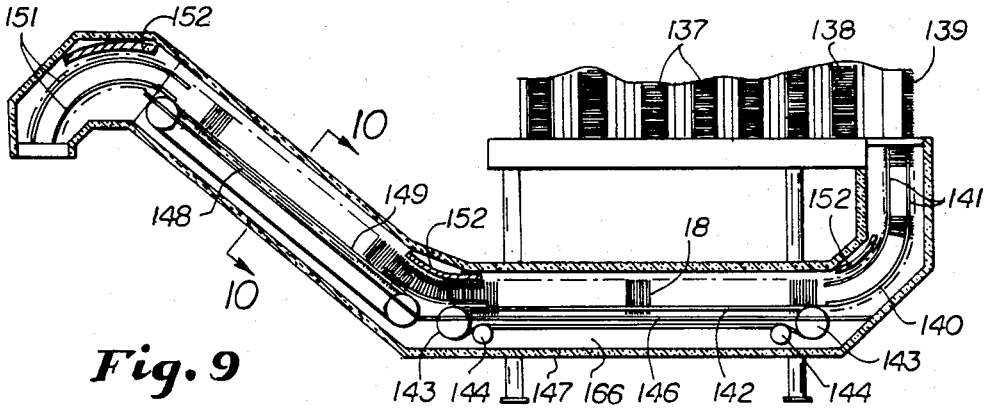
FIG. 9 is an enlarged sectional view through a portion of FIG. 8.
Figure 9A:
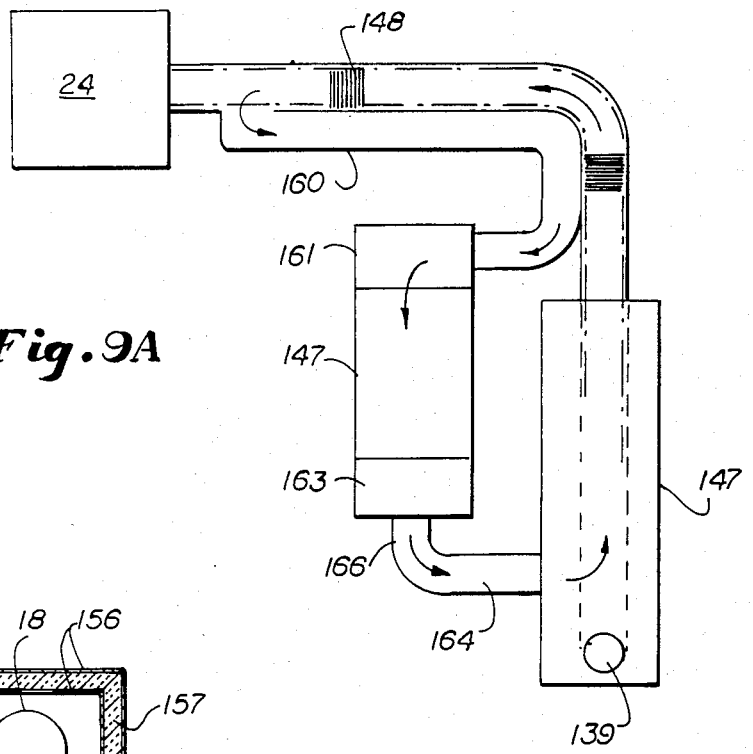
FIG. 9A is a schematic plan view of FIG. 9.
Figure 10:
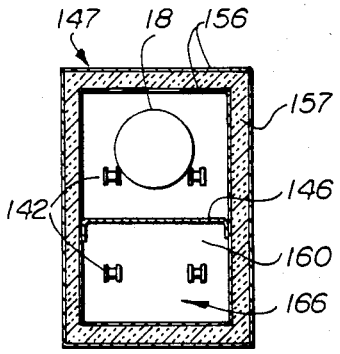
FIG. 10 is a transverse sectional view taken substantially along the line 10—10 of FIG. 9.

Mounted horizontally within the distal path of the tunnel 61 is helix 71. Helix 71 has at its proximal end flights 72 which are uniformly spaced apart slightly less than the diameter of the flanges 20 of the containers 19 being handled. It will be understood that for different size containers 19 different helices 71 are required. At the distal end of the helix 71 the flights 73 are spread apart, for a purpose which hereinafter appears. Shaft 74 of helix 71 is mounted in bearings 75 at either end. The containers 19 discharged off chain 62 are supported partially by horizontal plate 76 and partially by the vertical flange 78 of horizontal bar 77. There are hold-down bars 79 mounted horizontally to engage the top flanges of 20 of the containers 19. Bars 79 are supported by brackets 81. As best shown in FIG. 6 the bars 79 may be moved in and out to accommodate containers of different sizes. The containers 19 are partially supported and are driven by the flights 72, also as best shown in FIG. 6. The containers are kept in contact with the helix 71 by means of horizontally disposed vertically spaced apart tubes 82. Tubes 82 preferably perform an additional function in that sterile cooling water may be pumped therethrough and the tubes are formed with spray holes (not shown) which spray water against the sides of the containers 19, cooling and cleaning the same. The spray water darains from the tunnel 61 through drain 83.

Helix 71 is driven from a power take-off 86 of the closer 24. Thus the take-off sprocket 86 drives chain 87 which is connected to sprocket 88 on the shaft 74 of helix 71. Idler sprocket 89 maintains the chain 87 tight. Shielding 91 functions as a guide for containers 19 at one side.

There are windows 92 along the length of the tunnel 61 through which the attendant can observe the containers 19 as they pass under the filler which is to be described. A cover 93 is hinged by hinge 94 so that in case of malfunction the operator may obtain access to the interior of the tunnel 61. Within the tunnel 61 is a distributor 96 having air holes 96A which distributes air throughout the interior of the tunnel. There is a duct 97 alongside the tunnel 61 communicating at intervals with distributors 96. It will be understood that the tunnel 61 is preferably of double-walled construction and the space between the walls is filled with insulation 98 which may be a ceramic fiber. The materials of which the walls are constructed are preferably stainless steel both inside and out.

To sterilize the air within the tunnel 61 and also, importantly, to prevent the ingress of non-sterile atmospheric air, blower 101 is installed in a convenient location such as the top of the sterilizer 11 adjacent the blower 47. Blower 101 communicates with a heater 102 which heats the air to a temperature of about 400° F., thence to a horizontal duct 103 along the top of the sterilizer 21 and thence down through a vertical duct 104 to a horizontal duct 106 which communicates with the duct 97. At start-up, air is preferably at 450°-500° F. and then reduced.

Where it is desirable, a heat exchanger 107 may be installed in the vertical duct 104. The heat exchanger 107 has a coolant inlet 108 and a coolant outlet 109. Within the heat exchanger 107 are coils (not shown, but of a common commercial type) around which the hot air in the duct 104 circulates and by which its temperature is materially reduced. Some products deteriorate rapidly at high temperatures. Accordingly, it is desirable to cool the air emitted through duct 106, while maintaining its pressure above atmospheric. Such sterile air, cooled but above atmospheric pressure, is introduced in the filler 111. The pressure of the air prevents ingress of nonsterile air from the surrounding atmosphere. Since both the containers and the product have been pre-sterilized, contamination of the product in the containers is avoided. Low temperatures—if necessary, as low as 70° F.—may be used, a condition which is never achievable with the use of steam as contrasted with air.

Figure 14:
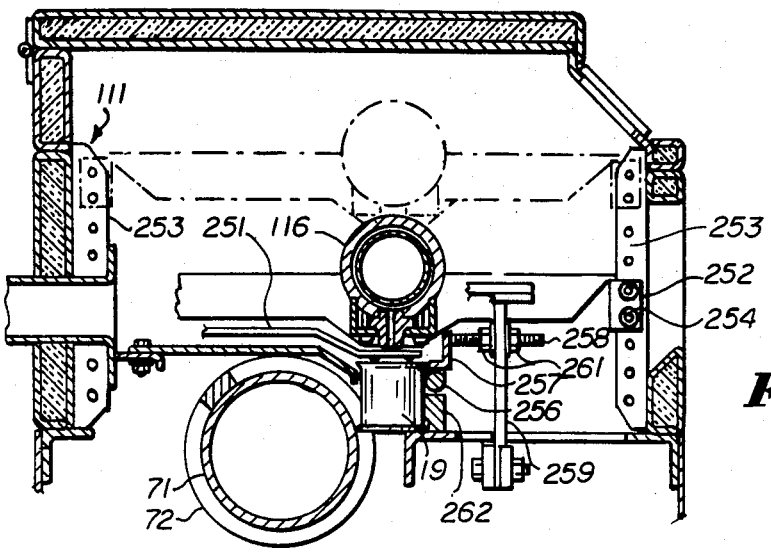
FIG. 14 is a sectional view similar to FIG. 6 of a modification.
Figure 15:
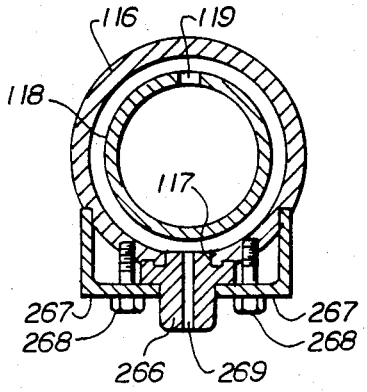
FIG. 15 is an enlarged sectional view of a portion of FIG. 14.

In the modification of FIG. 14, the filler 111 shown is a modification of a commercially known structure. It is mounted above the path of the containers 19 by means of horizontally outwardly extending brackets 251 spaced at intervals along the length of the filler 111. Each bracket 251 is received in a clamp 252 which is, in turn, supported from a vertical support 253 on the side of the filler by means of bolts 254. By raising and lowering the clamp 252—i.e., by inserting the bolts 254 through different holes in the support 253, the filler casing 116 may be raised and lowered.

The containers 19 are supported against lateral displacement by guides 256 fixed to brackets 257. Threaded rods 258 are threaded into the vertical flanges of brackets 257. These rods 258 pass through one of several vertically spaced holes in vertical support 259 and are fixed in place by means of nuts 261. Accordingly, by turning threaded rods 258, the brackets 257 and hence the guides 256 may be moved inward and outward so that the guides engage the walls of the containers 19 as they pass under the filler. By raising or lowering rods 258 and inserting same through different holes in support 259, guides may be positioned near the tops of containers 19. The lower edges of the containers 19 are guided by bottom guides 262.

Filler 111 has a horizontally disposed casing 116 formed with a continuous slit 117 along its bottom edge. Interchangeable inserts 266 of Teflon or other suitable material are attached to the slit 117 by means of brackets 267 held by bolts 268 into casing. The width of the slits 269 in the insert determines the rate of flow of product. By replacing the insert 266 different product flow may be obtained.

A curtain of product is discharged through the slit 269 in the insert 266 immediately above the path of the containers 19 as they are moved along by the helix 71. Pre-sterilized, cooled product is pumped or otherwise forced into a tube 118 within the casing 116. Tube 118 has holes 119 at intervals at its top so that the liquid or semi-liquid product is forced out through the holes 119 and into the interior of the casing 116. The product is fed through an inlet 112 at one end of tube 118. This structure of filler 111 has been found to promote more even distribution of product. The pitch of the flights 72 below the filler 111 is such that the containers 19 are forced together so that the flanges 20 partially overlap. Hence, there is a minimum of spillage of product discharged through slit 269.

Figure 13:
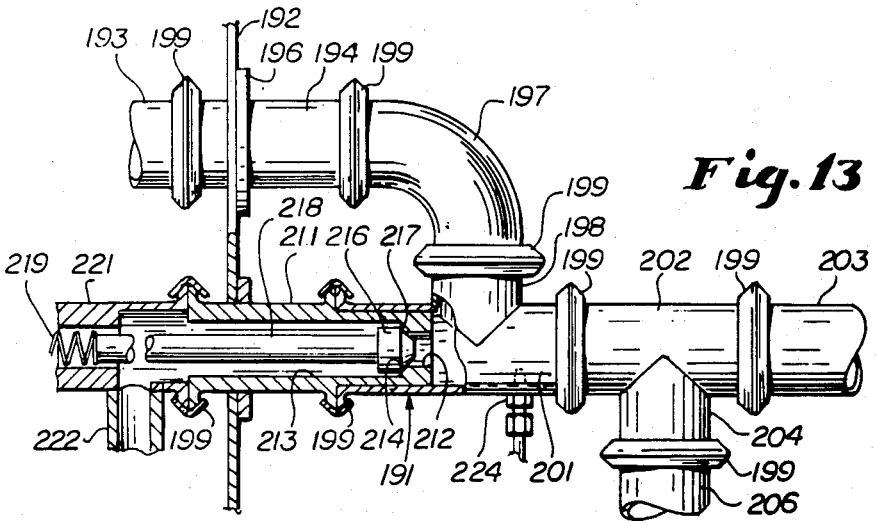
FIG. 13 is an enlarged elevational view, partly broken away, in section, of a valve which may be used in the system.

Directing attention to FIG. 13, a valve 191 which may be used to by-pass flow of product into filler 111, particularly where multiple fillers are used in a particular installation, is shown. Pre-sterilized, cooled product is pumped by a pump (not shown) in the product processing plant which is separated from the installation shown in FIG. 1 in many instances by a partition 192. A pipe 194 connects with the pipe 193 extending through the partition, the pipe 194 having a flange 196, which is fastened to the partition 192. Pipe 194 may be connected to an elbow 197. Used throughout the installation are quick-connect couplings 199 of conventional construction. Elbow 197 is connected to an intake 198 of the valve 191. Discharge port 201 of valve 191 is connected to a tee 202. The opposite end of tee 202 may be connected to a pipe 203 which leads to another filler. However, it may be considered that the discharge or vertical leg 204 of the tee 202 is connected by means of pipe 206 to the inlet 112 of the filler 111. Other means of connection may, of course, be employed.

Within the body 198 of valve 191 is sleeve 211 having a reduced diameter portion 212 and an enlarged diameter portion 213. The juncture of the portions 212 and 213 are formed with a seat 214, preferably conical. Valve head 216 is formed at one end with a taper 217 which matches the seat 214. Head 216 is connected to stem 218 which is biased by means of spring 219 into seating engagement. A fitting 221 is connected to the sleeve 211 and such fitting 221 has a discharge port 222 which leads back to the source of product. Temperature sensor 224 is connected to the body 201 to sense the temperature of product discharged therefrom.

In the use of the valve, the product is pumped by means not shown through the pipe 193. Normally, the head 216 is seated and product flows out through reduced diameter portion 212 to the right as viewed in FIG. 13 and thence through tee 202 and pipe 206 to the filler 111. In the event that the line is shut down or if the volume of product being pumped through the pipe 193 is excessive, the pressure within the reduced diameter portion 212 increases to the point where it overcomes the force of the spring 219 and the head 216 moves to the left as viewed in FIG. 13. Surplus product then flows out of the discharge port 222 back to the source of product. It will be noted that the discharge port 222 is preferably on the same side of the partition 192 as is the pipe 193.

Figure 16:
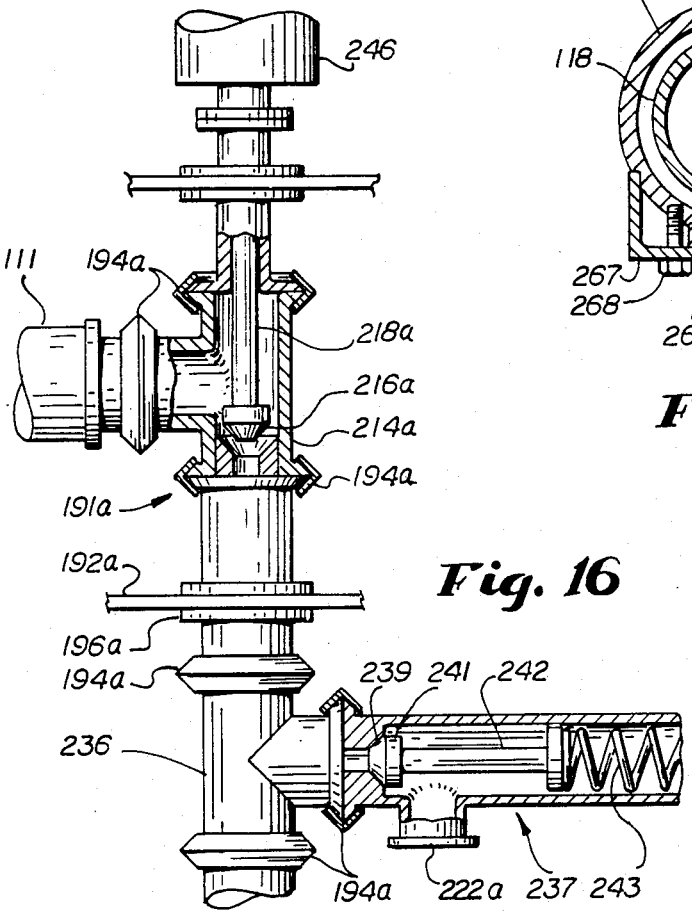
FIG. 16 is a view similar to FIG. 13 of a modified valve.

A modification of the valve heretofore described is illustrated in FIG. 16. In certain respects the valve of FIG. 16 resembles that shown in FIG. 13 and the same reference numerals followed by the subscript a are used to designate corresponding parts.

Product under pressure from a pump or gravity is introduced to one end of Tee 236. By quick-connect clamps **194*a*, the end of Tee 236 opposite that through which product is introduced is connected to a pipe 193*a* by means of quick-connect clamps 194*a* or other means. The pipe 193*a* passes through partition 192*a* and is secured thereto by flange 196*a*. On the product preparation side of partition 192*a* is a pressure relief valve 237. When the outlet of pipe 193*a* is closed (by means hereinafter explained) the pressure relief valve 237 opens to permit product to be discharged through port 222*a*** back to the source of product, thereby preventing waste.

Valve 237 has a T-shaped casing 238 formed with a seat 239. Reciprocable within the casing 238 is a valve head 241 which seats on seat 239, having a stem 242 which extends exteriorly of casing 238 and is biased by an adjustable spring 243. In normal operation, the head 241 seats on the seat 239. However, when the pressure exceeds the force of spring 243, head 241 unseats—i.e., moves to the right as viewed in FIG. 16, permitting excess product to flow out through the filler 111 through inlet 112. A sleeve 221*a* is installed in the intake arm of the valve 191*a*, this sleeve having a conical seat 214*a* against which head 216*a* may seat. Steam 218*a* of head 216*a* extends exteriorly of valve 191*a* to a valve actuator 246. Valve actuator 246 determines the opening and closing of the valve 191*a* and the amount of opening thereof to maintain the desired pressure within the filler 111 into which the valve 191*a* discharges. Where closure of the head 216*a* creates an excessive pressure in the pipe 193*a*, the pressure relief valve 237 unseats and excess product is discharged back to the source of product.

From the tunnel 61, containers 19 are transferred to the closer 24.

Figure 11:
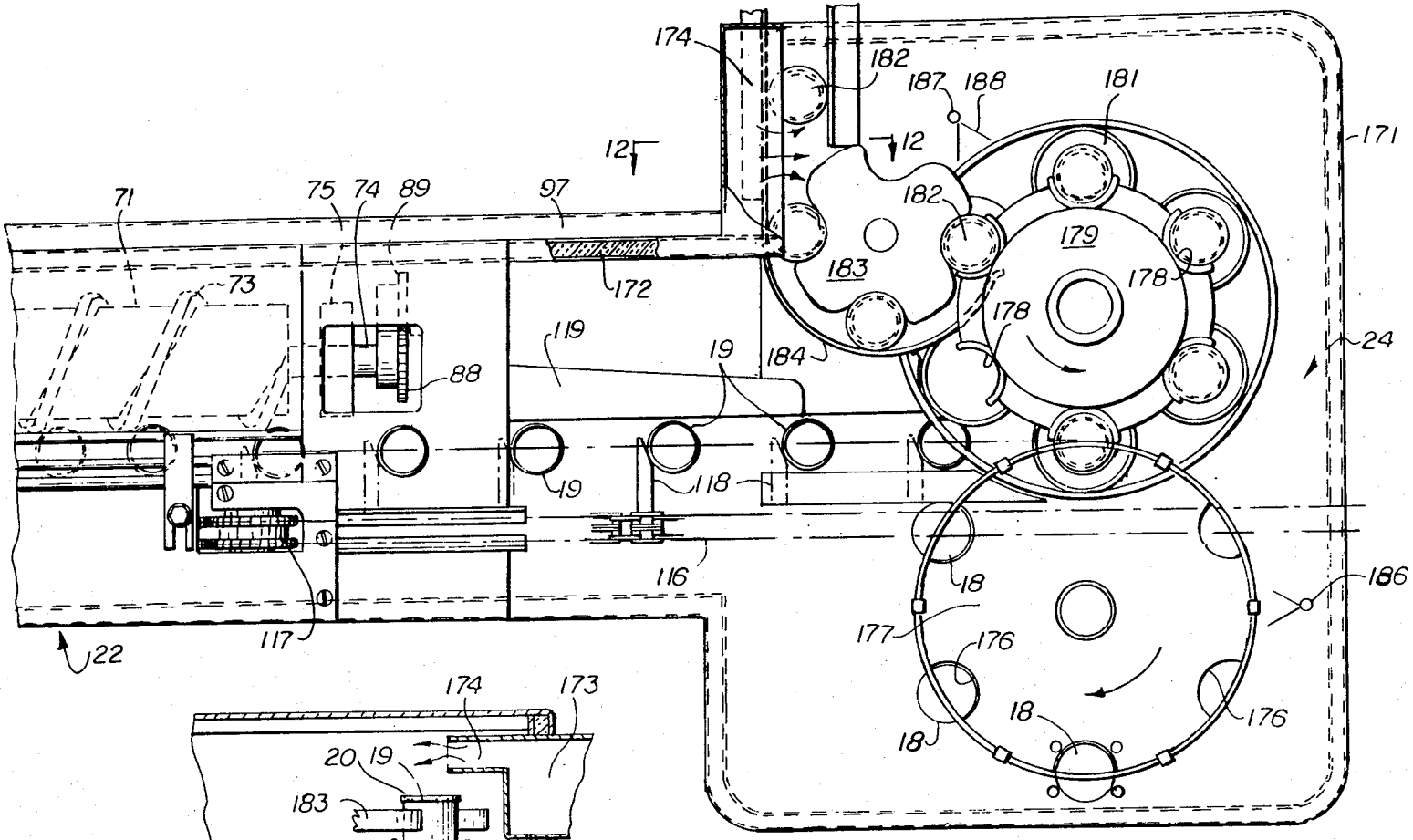
FIG. 11 is a schematic top plan view of a portion of a container closing machine with parts omitted for clarity and also showing a portion of the filler and tunnel.

As seen partially in FIG. 11, closer 24 has an inlet chain 116 which passes around a sprocket 117 at the distal end of the tunnel 22. Chain 116 has horizontal fingers 118 which are spaced apart a proper distance to feed containers into the turret of the closer (hereinafter described) and such spacing of fingers 118 is the same as the spacing of the spread flights 73. Guides 119 transfer the containers 19 discharged from the helix 71 into the spaces between the fingers 118.

CONTAINER LID FEED AND STERILIZER

In addition to the container 19 and product being sterilized and the packing and lid closing being performed in a sterile atmosphere, it is also necessary that the container lids 18 be sterilized. In a preferred form of the present invention, a modification of a Fleetwood Systems, Inc., lid feeder and conveyor 26 is used. One form of such Fleetwood apparatus is shown in U.S. Pat. No. 4,000,709. Details of the operation of such apparatus are set forth in the aforesaid patent. Generally, a magazine 136 is provided having a plurality of cover stack chutes 137 mounted so that the empty chutes are accessible to the attendant for filling with stacks of lids 18 obtained from the container manufacturing facility. The chutes 137 are mounted so that they are moved in a rotary path to one end 138, whereupon the lids 18 in that particular chute are moved outward into a vertically disposed transfer station 139 which connects with guides 141 which cause the lids to make a 90 degree curve bend 140 and assume a horizontal position. As the covers reach the lower end of the bend 140, they are deposited to rest upon a pair of stainless steel chains 142 driven around sprockets 143 at either end of the horizontal path. The chains 142 move the lids 18 along the horizontal path above horizontal partition 146. The return stretch of the chains 142 is below partition 146. After leaving the horizontal stretch, the lids are transferred to an upward inclined elevator 148 which has a similar chain 149 drive. At the upper end of the elevator 148 is a second 90 degree arcuate bend 151 which communicates with the top of the cover stack of closer 24, hereinafter described. Where steel lids are used, magnetic holddowns 152 are used to prevent lids from being forced out of the stack, as well understood in the industry. Non-steel lids are retained in position by mechanical means not illustrated herein, but understood in the art.

Casing 147 is provided around the lower end of the transfer station 139 and continues around the horizontal lower stretch and the inclined elevator 148 and the bend 151 which leads to the closing machine. The casing 147 preferably has double walls 156 with heat insulation material 157 between the walls 156. Mounted near the machine is a blower 161, the discharge 162 of which connects to a heater 163, which may be of various types, typically may be of the electric resistance type. From the heater 163 there is a duct 164 leading to an entrance duct 166 preferably located near the proximal end of the casing 147. As the lids 18 move through the horizontal and inclined stretches, hot air circulates around the lids and sterilizes them. Sterility is maintained until the lids enter the closer 24. Return air is recirculated through return duct 166 below partition 146. Closer 161 draws air from return duct 166. As hereinafter appears, the closer 24 is also in a sterile atmosphere with non-sterile atmospheric air excluded by reason of the pressure inside the enclosure of the closer.

CLOSING MACHINE

Figure 12:
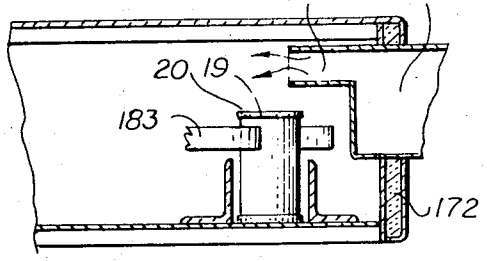
FIG. 12 is a sectional view taken substantially along the line 12—12 of FIG. 11.

The closer 24 shown particularly in FIGS. 11 and 12 is an adaptation of the enclosed closer illustrated and described in U.S. Pat. No. 3,349,542 except that steam is not used therein. An enclosure 171 which communicates with the tunnel 71 feed and filler is double-walled and provided with insulation 172 completely encloses the closer 24. Since sterile air is forced into the enclosure, the pressure is greater than atmospheric and this ensures that non-sterile air cannot enter the enclosure. Duct 97 which extends alongside the conveyor 22 is formed with a bend 173 which communicates with a distributor 174 inside the enclosure adjacent the discharge of the seamed containers.

The sterilized lids 18 which have been deposited into the closer from the lid sterilizer 27 heretofore described are fed one at a time into pockets 176 in the lid turret 177. Further, containers 19 are advanced by the fingers 118 of the conveyor chain 116 and are fed into the pockets 178 of the main turret 179 of the closer. The lids 18 on the lid turret 177 are brought into position over the containers 19 by timed rotation of the lid turret 177. By means well known in the seamer art, the lifters 181 of the main turret lift each container 19 into contact with a lid 18 and thereupon seaming rolls (not shown) attach the lid to the container. The completed container 182 is then transferred into the discharge star wheel 183 and thence guided by guides 184 out of the system. The details of the closing machine are not herein illustrated, being of any of several well-known types. The preferred form herein illustrated is the Angelus model 60L seamer which is shown partially in said U.S. Pat. No. 3,349,542.

One of the features of the closer apparatus is the provision of vertical pipes 186 and 187. Pipe 186 sprays sterile cool water through holes onto the lid push fingers (not shown) to keep them clean. Sprays 188 of pipe 187 are in a vertical line and spray sterile, cooled liquid on the container lifter 183 and also on the seaming rolls (not shown) to prevent build-up of product thereon.

Although sterile air in the closer 24 is the preferred way of preventing ingress of atmospheric air, nitrogen or steam (in accordance with conventional practice) may be used.

What is claimed is:

1. A filler for use with a hot air aseptic packaging system comprising, a tunnel, a straight-line conveyor in said tunnel receiving sterile, empty containers at a first end and discharging said containers filled with sterile product at a second end, a filler in said tunnel positioned above said conveyor, first means for delivering said sterile product to said filler, second means for delivering sterile air under pressure to said tunnel, support means supporting said filler from said tunnel, said filler comprising a casing extending longitudinally above the path of said containers as they are moved along said conveyor, said casing being formed at its bottom with an elongated longitudinal first slit, a tube of lesser diameter than the interior of said casing disposed within said casing perforated at its top and connected to said first means, said tube being separated from said casing by a space, an elongated insert formed with a second slit disposed in said first slit, and detachable means securing said insert to said casing, whereby said insert may be replaced with another insert having a second slit of different width, product received by said tube flowing into said space between said tube and said casing, thence out through said second slit and into said containers.

2. A filler according to claim 1 in which said conveyor comprises a helical screw having a first section of a first pitch and a second section of a second pitch greater than said first pitch, said filler accommodating containers having top outward flaring flanges, said first pitch being less than the outside diameter of said flanges to force the flanges of adjacent containers into close proximity.

3. A filler according to claim 1 which further comprises cooling means in said tunnel to reduce the temperature of said containers.

4. A filler according to claim 3 in which said cooling means comprises a pipe and means for circulating sterile cool fluid through said pipe, said pipe having a spray aperture to spray fluid onto the exteriors of said containers.

5. A filler according to claim 1 in which said first means for delivering sterile air further comprises cooling means for cooling said sterile air.

6. A filler according to claim 1 in which said support means comprises vertical members on either side of said tunnel, brackets fixed to said casing and extending outward to either side of said tunnel, and clamp means to clamp the outer ends of said brackets to said vertical members, said clamp means being detachable, whereby said filler may be raised or lowered relative to said conveyor to accommodate containers of different heights.

7. A filler according to claim 1 in which said first means comprises pressure means for creating pressure above atmospheric in said product and a valve between said pressure-raising means and said filler, said valve having a discharge port, a seat inward of said discharge port, a head shaped to engage said seat, resilient means biasing said head into engagement with said seat when the pressure in said valve overcomes the force of said resilient means, whereby excess product is discharged from said valve through said discharge port.

8. A filler according to claim 7 which further comprises a second valve between said first mentioned valve and said filler, said second valve having a second seat, a second head, and an external actuator for closing said second head against said second seat and for moving said second head away from said second seat variable distances.

* * * * *